United States Patent [19]

Oti

[11] Patent Number: 5,046,547

[45] Date of Patent: Sep. 10, 1991

[54] CASTING METHOD

[75] Inventor: James A. Oti, Richmond Heights, Ohio

[73] Assignee: PCC Airfoils, Inc., Cleveland, Ohio

[21] Appl. No.: 477,717

[22] Filed: Feb. 9, 1990

[51] Int. Cl.[5] ..... B22D 27/04

[52] U.S. Cl. ..... 164/122.1; 164/122.2

[58] Field of Search ..... 164/338.1, 361, 122.1, 164/122.2

[56] References Cited

U.S. PATENT DOCUMENTS

| | | |
|---|---|---|
| 3,385,346 | 5/1968 | Fleck . |
| 3,633,648 | 1/1972 | Barrow et al. . |
| 3,795,978 | 3/1974 | Raymond et al. . |
| 3,810,504 | 5/1974 | Piwonka . |
| 4,712,604 | 12/1987 | Sawyer . |

*Primary Examiner*—Kuang Y. Lin

*Attorney, Agent, or Firm*—Tarolli, Sundheim & Covell

[57] ABSTRACT

An improved method of casting provides for the blocking of the upper end portion of a mold structure during preheating of the mold structure in a furnace and/or withdrawal of the mold structure from the furnace. The mold structure is raised into a furnace chamber with a cover blocking the upper end portion of the mold structure. In the illustrated embodiment of the invention, the cover moves upwardly through the furnace chamber to a location immediately above an upper sidewall of the furnace chamber. When the mold has been preheated, the cover is removed and molten metal is pored into the mold structure. The cover is then replaced on the mold structure. The molten metal in the mold structure is solidified by slowly withdrawing the mold structure from the furnace chamber with the cover blocking the upper end portion of the mold structure. Once the mold structure has been completely withdrawn from the furnace chamber and the molten metal in the mold structure has solidified, the cover is removed.

36 Claims, 3 Drawing Sheets

CASTING METHOD

BACKGROUND OF THE INVENTION

The present invention relates to a new and improved casting method and, more specifically, to a casting method in which a mold structure is preheated in a furnace chamber, molten metal is poured into the preheated mold structure, and the mold structure is withdrawn from the furnace chamber.

During the manufacture of superalloy castings, it is a common practice to place a ceramic mold on a chill plate made of copper or other heat conductive material. The ceramic mold is preheated in an evacuated furnace chamber surrounded by an induction coil and graphite susceptor which forms the inner wall of the furnace chamber. During the casting process, temperatures can get as high as 3,000 degrees F. These high temperatures, coupled with the vacuum, can cause decomposition of the binder system used in the mold. In addition, these high temperatures can cause components of the furnace, such as the graphite susceptor, insulating materials between the susceptor and the induction coil, and insulating material that covers the top of the induction coil, to decompose. The decomposed materials, including gases, move into the mold where they are deposited and/or trapped. Upon the introduction of molten metal into the mold, the molten metal reacts with the trapped gases and/or deposited material, altering the chemistry of the molten metal. The contaminants become embedded in the castings and can result in the castings being rejected.

It has previously been suggested that the accumulation of contaminants in a mold could be retarded by providing a hollow cover for an opening in an upper side wall of the furnace chamber. It is believed that the contaminants tend to become deposited or condensed on surfaces inside the cover rather than in the mold. This method of avoiding the accumulation of contaminants in a mold is described in U.S. Pat. No. 3,385,346, issued May 28, 1968 and entitled "Method and Apparatus for Removal of Condensed Deposits From Mold Covers".

SUMMARY OF THE INVENTION

The present invention prevents the introduction of contaminants into a mold structure during preheating of the mold structure and/or prevents volatilization of constituent elements from molten metal in the mold structure during solidification of the molten metal. During a casting operation, an upper end portion of a mold structure is blocked to prevent movement of fluid through the upper end portion of the mold structure. The mold structure may be preheated while the upper end portion of the mold structure is blocked. When the upper end portion of the mold structure is blocked during preheating of the mold structure, contaminants in the environment around the mold structure cannot enter the mold structure.

Once the mold structure has been preheated to the desired temperature, a flow of molten metal is conducted into the mold structure. Thereafter, the upper end portion of the mold structure may again be blocked. The mold structure may then be withdrawn from the furnace chamber while the upper end portion of the mold structure is blocked. By blocking the upper end portion of the mold structure during withdrawal of the mold structure from the furnace chamber, volatilization of elements in the molten metal is blocked and the rate of heat loss from the upper end portion of the mold structure is reduced. Although it is preferred to block the upper end portion of the mold structure during preheating of the mold structure and withdrawal of the mold structure from the furnace, the upper end portion of the mold structure may be blocked during only one of these steps.

Accordingly, it is an object of this invention to provide a new and improved casting method in which the upper end portion of a mold structure is blocked during preheating of the mold structure and/or during withdrawal of the mold structure from a furnace.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
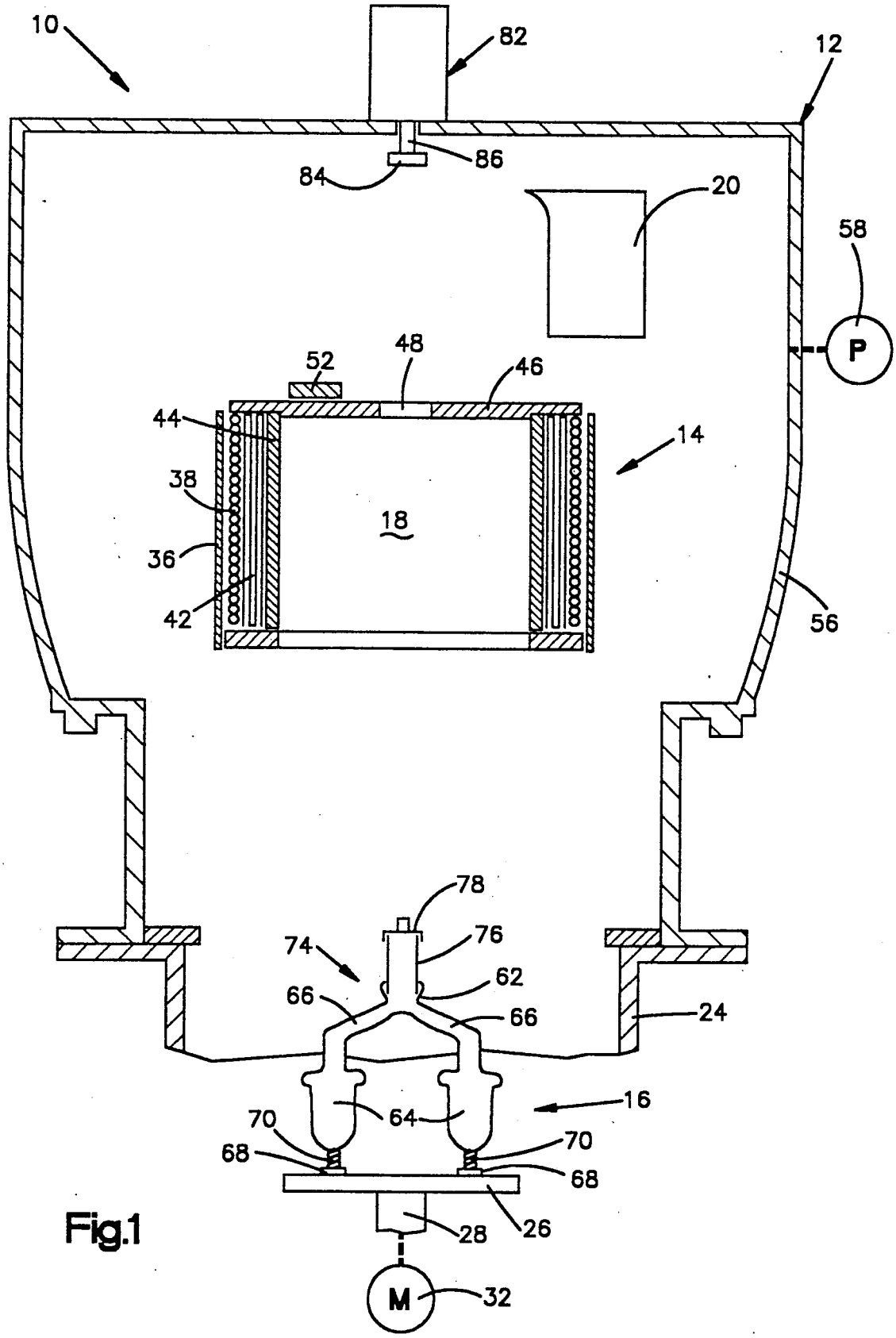
FIG. 1 is a schematic illustration depicting the relationship between a mold structure and a furnace chamber prior to movement of the mold structure into the furnace chamber.

A casting apparatus 10 (FIG. 1) includes a housing 12 which encloses a furnace 14. A mold structure 16 is movable into a cylindrical chamber 18 in the furnace 14. While the mold structure 16 is in the furnace chamber 18, the mold structure is preheated and, thereafter, molten metal is poured from a crucible 20 into the mold structure. The mold structure 16 is then withdrawn from the furnace chamber 18.

The housing 12 includes a lower portion 24 having a door through which the mold structure 16 is positioned on a circular water cooled copper chill plate 26. The chill plate 26 is disposed on the upper end of a vertical support post 28. A motor 32 is operable to vertically raise and lower the support post 28 and chill plate 26 in a known manner.

The furnace 14 is of the well known induction type. The furnace 14 includes a cylindrical outer wall 36 which extends around an induction coil 38. A cylindrical layer 42 of insulation is disposed inwardly of the induction coil 38. A cylindrical graphite susceptor wall 44 forms a side wall of the furnace chamber 18. A circular upper side wall 46 extends across the upper end of the susceptor 44, insulation 42 and induction coil 38. A circular central opening 48 in the upper side wall 46 of the furnace 14 can be blocked by a plug 52 if desired.

The crucible 20 holds metal which is to be poured into the mold structure 16 after the mold structure has been preheated in the furnace 14. The metal to be poured is melted in the crucible 20 shortly before pouring. Although many different types of metal could be poured into the mold structure 16, in one specific instance, the molten metal poured from the crucible 20 was a nickelchrome superalloy. However, it is contemplated that titanium or other metals could be poured from the crucible 20 if desired.

An upper portion 56 of the housing 12 is evacuated by a pump 58. A valve (flap) (not shown) is provided between the upper portion 56 and the lower portion 24 of the housing 12. The valve prevents loss of vacuum when the door in the lower portion 24 of the housing is opened to enable the mold structure 14 to be placed on the chill plate 26 At this time, the valve between the upper and lower portions 24 and 56 of the housing is closed so that the relatively high pressure fluid in the lower portion 24 of the housing 12 cannot enter the upper portion 56 of the housing.

Once the door has been closed and sealed, the valve between the upper and lower portions 56 and 24 of the housing 12 can be opened and the mold structure 14 raised upwardly into the furnace chamber 18 by operation of the motor 32. When the valve is opened to enable the mold structure 16 to be raised into the furnace chamber 18, the pump 58 is effective to evacuate both the upper and lower portions 56 and 24 of the housing 12. Of course, a separate pump could be provided for the lower portion 24 of the housing 12. If this were done, the lower portion 24 of the housing would be evacuated before the valve was opened to enable the mold structure 16 to be moved upwardly into the furnace 14.

The general construction of the casting apparatus 10 is well known. Thus, the relationship between the housing 12 and the furnace 14 is the same as is shown in U.S. Pat. No. 3,841,384. The crucible 20 may be moved to pour molten metal in any desired manner, such as that shown in U.S. Pat. Nos. 3,584,676 or 3,747,808.

The mold structure 16 is formed of a gas permeable ceramic mold material. The mold structure 16 is formed by the well known lost wax process. Thus, a wax pattern of the mold structure is prepared A wet covering of ceramic mold material is applied over the outside of the wax pattern. The wax pattern is then removed from the covering to form a plurality of article mold cavities.

In the illustrated embodiment of the invention, the mold structure 16 includes a pour cup 62 which is connected in fluid communication with article molds 64 by runners 66. An article mold cavity having a configuration corresponding to the configuration of an article to be cast is formed in each of the article molds 64. Starter cavities 68 are connected with the article molds 64 through single crystal selectors 70. The lower ends of the starter cavities 68 are open to the upper side surface of the chill plate 26.

Although the mold structure 16 is for the production of single crystal cast articles, a different mold structure could be provided to cast articles having a different crystallographic structure if desired. Thus, a known mold structure for the casting columnar grain articles could be used in place of the mold structure 16. Of course, if columnar grain articles were to be cast, the mold structure would not have single crystal selectors.

The mold structure 16 has an elongated open upper end portion 74. Thus, a cylindrical collar 76 is formed separately from and extends upwardly from the pour cup 62. The pour cup 62 and collar 76 cooperate to form the upper end portion 74 of the mold structure 16. Although it is presently preferred to form the collar 76 separately from the pour cup 62, the collar 76 could be formed as one piece with the pour cup 62 if desired. Thus, the open upper end portion 74 of the mold structure 16 could be formed by just a pour cup without the collar 76.

In accordance with a feature of the present invention, the open upper end portion 74 of the mold structure 16 is blocked during preheating of the mold structure in the furnace 16 and/or withdrawal of the mold structure from the furnace. In the illustrated embodiment of the invention, the open upper end portion 74 of the mold structure 16 is blocked by a ceramic cover 78. Other devices could be used to block the upper end portion 74 of the mold structure 16 if desired.

Blocking the upper end portion 74 of the mold structure 16 during preheating prevents the introduction of contaminants into the mold structure. During preheating of the mold structure 16, the temperature of the mold structure may get as high as 3,000 degrees F. This high temperature, coupled with the vacuum in the housing 12, can cause decomposition of the binder system used in the mold structure 16. In addition, the graphite susceptor 44 and insulation 42 in the furnace 14 may decompose at high temperatures. By blocking the open upper end portion 74 of the mold structure 16 with the circular cover 78, movement of contaminants into the mold structure is prevented.

Since the mold structure is supported by the water cooled copper chill plate 26, contaminants which enter the mold structure tend to condense in the lower portion of the mold structure. By blocking the upper end portion 74 of the mold structure with the cover 78 during preheating of the mold structure in the furnace 18, the entry and condensing of contaminants in the mold structure is minimized.

Blocking the upper end portion 74 of the mold structure with the cover 78 during withdrawal of the mold structure 16 from the furnace 14 prevents volatilization of constituent elements from the molten metal during the solidification process. Therefore, depletion of reactive elements in the molten metal is prevented. In addition, the molten metal cannot react with any gases which may be present in the furnace chamber 18.

Improved heat gradients are provided by blocking the open upper end portion 74 of the mold structure 16 with the cover 78. This is because heat loss from the open pour cup 62 is reduced. Since heat loss is reduced from the upper end portion of the mold structure 16, the flow of heat downwardly to the chill plate 26 is improved. This reduces the need to power-up during withdrawal of the mold structure from the furnace. In addition, the improved heat gradients can result in an increase in casting yields.

Although it is preferred to block the upper end portion 74 of the mold structure 16 during both preheating of the mold structure and withdrawal of the mold structure from the furnace 14, the upper end portion of the mold structure could be blocked only during preheating or only during withdrawal of the mold structure.

Casting Method

When articles, such as turbine engine components, are to be cast in the mold structure 16, the chill plate 26 is moved to a fully lowered position by operation of the motor 32. At this time, the chill plate 26 is approximately aligned with the lower edge of the door in the lower portion 24 of the housing 12. The valve between the upper and lower portions 56 and 24 of the housing 12 is closed.

The door in the lower portion 24 of the housing 12 is then opened to provide access to the chill plate 26. The mold structure 16 is moved through the door onto the chill plate 26. It is preferred to place the cover 78 on the upper end portion 74 of the mold structure 16 before the mold structure is moved into the housing 12. However, the cover 78 could be placed on the mold structure 16 after the mold structure has been moved into the housing 12.

Once the mold structure 16, with the cover 78 thereon, has been placed on the chill plate 26, the door in the lower portion 24 of the housing 12 is closed and sealed. The lower portion 24 of the housing can then be evacuated or the valve between the upper and lower portions 56 and 24 of the housing 12 can be opened without evacuating the lower portion 24 of the chamber. When the valve is opened without evacuating the lower portion 24 of the housing 12, the pump 58 is effective to evacuate both the upper and lower portions 56 and 24 of the housing 12.

As the housing 12 is evacuated, the interior of the mold structure 16 is evacuated. During evacuation of the mold structure 16, there may be a slight leakage between the rim of the collar 76 and the cover 78. If the fluid in the mold structure 16 does not leak out between the collar 76 and cover 78, the relatively high fluid pressure in the mold structure 16 will cause the cover 76 to lift up slightly to enable the gas in the mold structure 16 to escape. Of course, there will be some leakage of gas through the ceramic material of the mold structure 16. Although it is preferred to evacuate the mold structure 16 with the cover 78 blocking the upper end portion 74 of the mold structure, if desired, the cover could be placed on the mold structure after the mold structure has been evacuated.

The mold structure 16 is moved into the furnace chamber 18 by operating the motor 32 to raise the chill plate 26. As the mold structure 16 is raised upwardly, the upper end portion 74 of the mold structure 16 and the cover 78 move into the furnace chamber 18. As the mold structure 16 is moved upwardly with the chill plate 26 by the motor 32, the central axis of the cylindrical collar 76 and the central axis of the circular cover 78 are aligned with the central axis of the circular opening 48 in the upper side wall 46 of the furnace 14. Therefore, as the mold structure 16 continues to move upwardly into the furnace chamber, the cover 78 and upper portion 74 of the mold structure move through the opening 48 to the outside of the furnace 14 (FIG. 2).

Figure 2:
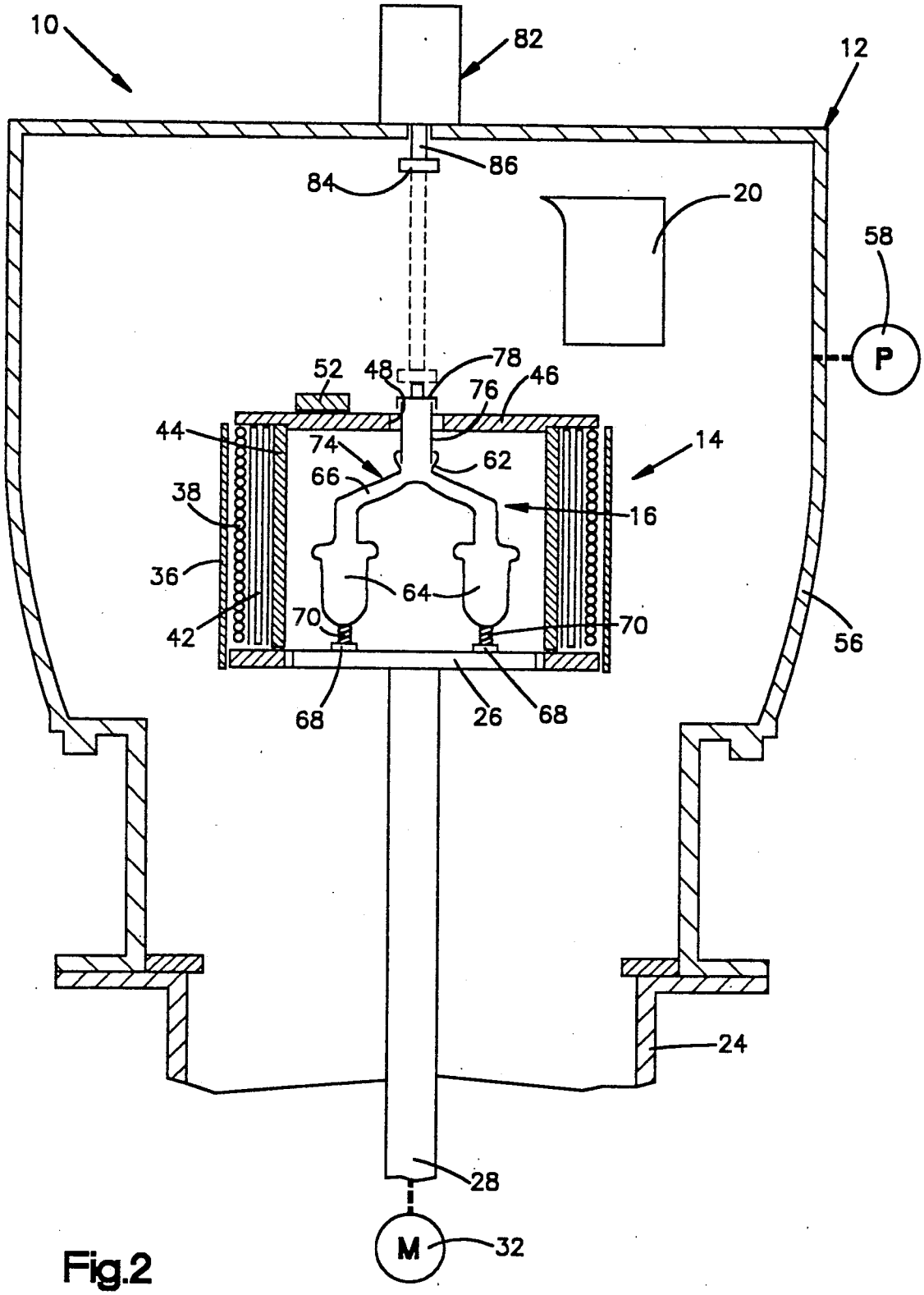
FIG. 2 is a schematic illustration, generally similar to FIG. 1, illustrating the relationship between the mold structure and the furnace chamber when the mold structure has been moved into the furnace chamber.

When the mold structure 16 is in the furnace chamber 18, the collar 76 extends through the opening 48 (FIG. 2). At this time, the cover 78 is outside of the furnace chamber 18 and is disposed adjacent to and slightly above the upper side wall 46 of the furnace 14. Thus, as the mold structure 16 moves into the furnace chamber 18, the cover moves from a location beneath the furnace 14, through the furnace chamber 18, to a location outside the furnace 14 and adjacent to the upper side wall 46 of the furnace 14.

Although it is preferred to place the cover 78 o the mold structure 16 while the mold structure is outside of the housing 12, in the manner previously explained, the cover could be placed on the mold structure 16 after the mold structure has moved into the furnace chamber 18. Thus, the cover 78 could be connected with a cover handling mechanism 82 before the mold structure 16 is moved into the furnace chamber 18. The mold structure 16 would then be moved into the furnace chamber 18 with the uppor end portion 74 of the mold structure unblocked. This would facilitate the evacuation of the mold structure 16. Once the mold structure 16 has been moved into the furnace chamber 18, the cover 78 could be placed on the upper end of the collar 76 by the cover handling mechanism 82, in the manner illustrated in FIG. 2.

Although it is preferred to have the upper portion of the mold structure 16 move part way through the opening 48, the entire mold structure could remain in the furnace chamber 18 if desired. For example, the cylindrical collar 76 could be omitted and the cover 78 placed directly over the pour cup 62. This would result in the cover 78 being beneath the upper side wall 46 of the furnace chamber 18. This would allow the plug 52 to close the opening 48 during movement of the mold structure 16 into the furnace chamber 18 and during preheating of the mold structure. When the collar 76 extends through the opening 48 and the cover 78 is disposed above the upper side wall 46 of the furnace 14, in the manner shown in FIG. 2, the mold structure itself blocks the opening 48.

Once the evacuated mold structure 16 has been positioned in the evacauated furnace chamber 18, as shown in FIG. 2, the mold structure is preheated to a relatively high temperature, that is to a temperature which may be as high as 3,000 degrees F. To preheat the mold structure 16, the induction coil 38 is energized. During preheating of the mold structure 16, the cover 78 remains on the upper end portion of the collar 76 to block movement of any gases in the housing 12 into the mold structure 16.

In the absence of the cover 78, contaminants would move into the article molds 64. Thus, contaminants in mold cavities in the article molds 64, single crystal selectors 70 and starter cavities 68 would condense on relatively cool surface areas of the mold structure. This would result in additional gases and contaminants tending to migrate into the open mold structure 16. However, by blocking the upper end portion of the mold structure 16 with the cover 78 during preheating of the mold structure, movement of gases and contaminants into the mold structure are blocked. During preheating of the mold structure 16, the housing 12 and mold structure 16 are maintained in an evacuated condition by the pump 58.

Once the mold structure 16 has been preheated, the cover 78 is removed and molten metal is poured from the crucible 20 into the evacuated mold structure. To remove the circular ceramic cover 78, a gripper 84 on the lower end of a piston rod 86 of the cover handling mechanism 82 is moved downwardly from the position shown in solid lines in FIG. 2 to the position shown in dashed lines in FIG. 2. When the gripper has been moved downwardly to the position shown in dashed lines in FIG. 2, the gripper engages projections or hooks on the upper end of the cover 78 to connect the cover with the cover handling mechanism 82. Although it is preferred to provide a mechanical connection between the gripper 84 and the hooks on the upper side of the cover 78, the gripper 84 could be magnetically connected with metallic projections on the upper side of the cover 78 if desired.

Figure 3:
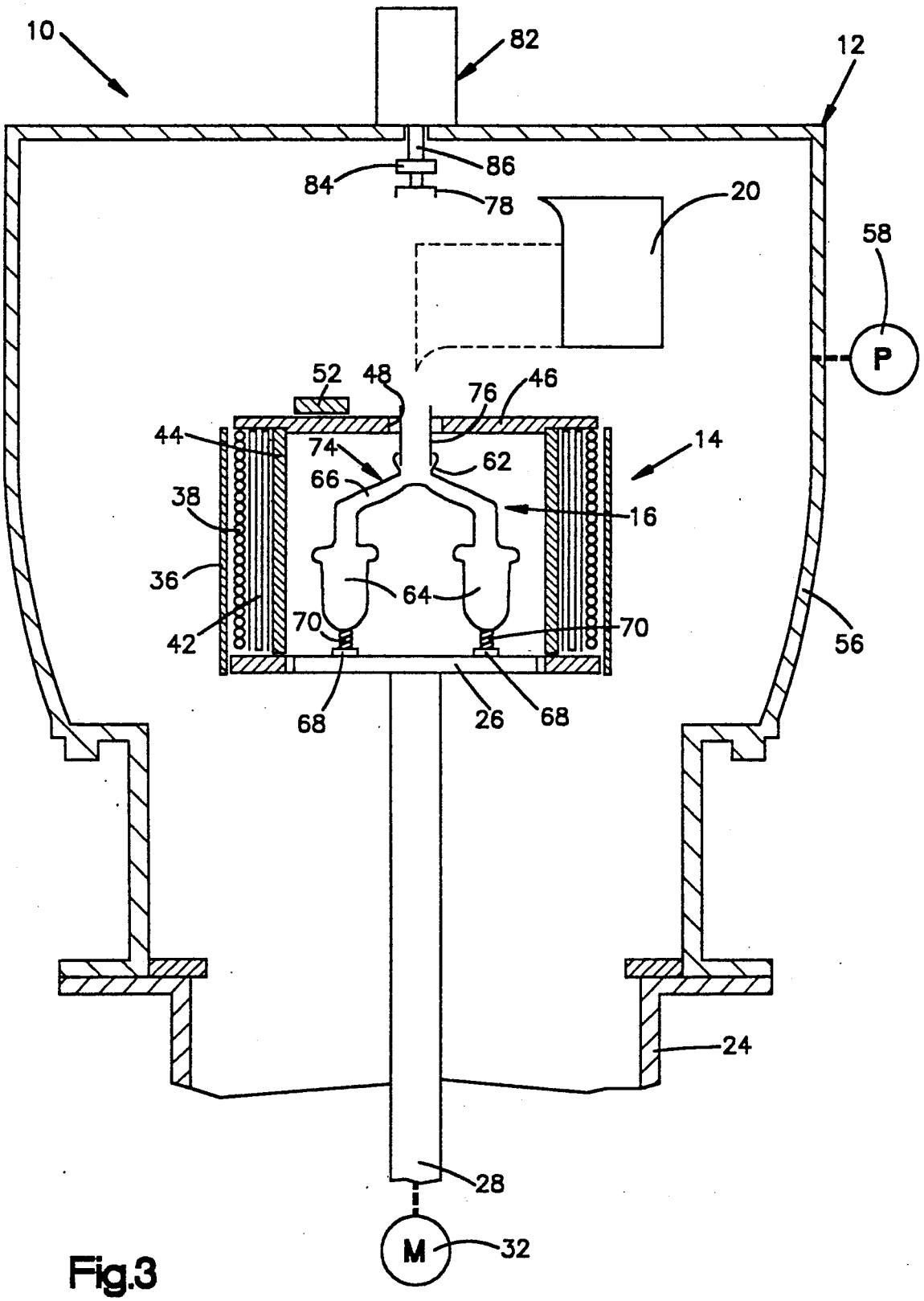
FIG. 3 is a schematic illustration, generally similar to FIGS. 1 and 2, illustrating the manner in which a cover is removed from the upper end portion of the mold structure to enable molten metal to be poured into the mold structure.

Once the gripper 84 has engaged the hooks on the upper side of the cover 78, the piston rod 86 is retracted to lift the cover upwardly from the closed position shown in FIG. 2 to the open position shown in FIG. 3. Since the cover 78 is outside of the furnace chamber 18, there is a minimal possibility of interference between the cover 78 and the furnace 14 as the cover is lifted from the closed position to the open position.

In one specific embodiment of the invention, a pair of hooks were provided on the upper side of the cover 78. The gripper 84 was lowered to a position in which a bar in the gripper was immediately beneath the hooks. The bar was then rotated about a vertical axis to move the bar beneath the hooks. The cover handling mechanism 82 was then operated to retract the piston rod 86 and move the cover upwardly to the open position of FIG. 3. However, it should be understood that many different types of cover grippers 84 could be utilized to engage the cover 78 while it is in the closed position of FIG. 2 and to hold the cover while it is moved upwardly to the open position of FIG. 3.

Although the cover 78 has been shown in FIG. 2 as fitting over the upper end of the mold structure 16 when the cover is in the closed or blocking position, the cover could be received in the upper end portion 74 of the mold structure 16. Thus, the upper end portion of the collar 76 could be shaped so as to receive the cover 78 inside of the collar 76. If this were done, the cover could be a plug having a truncated conical configuration. While it is preferred to have the upper end portion of the mold structure 16 extend through the opening 48 in the upper side wall 46, the upper end of the mold structure could extend part way through the opening or could terminate adjacent to the lower side surface of the upper side wall 46.

Once the cover 78 has been moved to the open position of FIG. 3, molten metal is poured from the crucible 20 into the evacuated mold structure 16. The metal in the crucible 20 is melted shortly before pouring to prevent depletion of reactive elements from the metal in the crucible. If desired, the crucible 20 could be covered until shortly before pouring.

When the molten metal is to be poured, the crucible 20 is tipped from the upright orientation shown in solid lines in FIG. 3 to the tilted orientation shown in dashed lines in FIG. 3. As the crucible 20 is tipped, molten metal flows from the crucible through a circular opening at the upper end of the cylindrical collar 76. The molten metal flows downwardly in the collar 76 and through the opening 48 in the upper side wall 46 of the furnace 14. The molten metal then flows from the collar 76 into the pour cup 62.

The molten metal flows from the pour cup 62 through the runners 66 to evacuated article mold cavities in the article molds 64. The molten metal flows through the article molds 64 and single crystal selectors 70 to the starter cavities 68. At the open lower ends of the starter cavities 68, the molten metal engages the chill plate 26 and immediately begins to solidify. However, the furnace 14 maintains the portion of the mold structure 16 above the chill plate 26 so hot that the molten metal does not immediately solidify upwardly from the starter cavity 68 into the single crystal selectors 70.

When the mold structure 16, including the pour cup 62, have been filled with molten metal, the crucible is tipped back to the upright position shown in solid lines in FIG. 3. The covering handling mechanism 82 is then operated to move the cover 78 downwardly onto the upper end of the mold structure 16 (FIG. 2). The gripper 84 is then disengaged from the cover 78 and the piston rod 86 retracted from the position shown in dashed lines to the position shown in solid lines in FIG. 2. The cover 78 remains on the mold structure 16 until after the molten metal in the mold structure has solidified.

The cover 78 prevents volatilization of reactive elements in the molten metal after the molten metal ha been poured into the mold structure 16. Therefore, a depletion of the reactive elements in the molten metal is prevented during solidification of the molten metal in the mold structure 16. In addition, the cover 78 retards the loss of heat from the molten metal in the pour cup 62.

To effect solidification of the molten metal in the mold structure 16 along a horizontal front, the chill plate 26 is slowly lowered to withdraw the mold structure 16 from the evacuated furnace chamber 18. As the chill plate 26 is lowered by operation of the motor 32, the molten metal solidifies upwardly from the starter cavity 68 into the crystal selector 70. As the gradual withdrawal of the mold structure 16 from the furnace chamber 18 continues, a single crystal of metal solidifies upwardly from the selector 70 into the article mold 64. Continued gradual lowering of the mold structure 16 results in the molten metal in the article mold 64 solidifying along a horizontal front as a single crystal.

The time required for the solidification of the molten metal in the article molds 64 as single crystals may be approximately one hour. During this time, the cover 78 blocks the upper end portion 74 of the mold structure 16 to prevent vaporization of reactive elements in the molten metal and a resulting depletion of the amount of the reactive elements in the molten metal. I n addition, the cover 78 retards the transfer of heat from the molten metal in the upper end portion 74 of the mold structure 16 to thereby minimize the power requirements of the furnace 14 during solidification.

Once the article molds 64 have been completely withdrawn from the evacuated furnace chamber 18 and the molten metal in the article molds solidified (FIG. 1), the rate of withdrawal of the mold structure 16 from the furnace chamber 18 can be increased. Thus, the speed of operation of the motor 32 is increased to increase the rate of downward movement of the chill plate 26.

After the mold structure has moved through the valve separating the evacuated upper portion 56 of the housing 12 from the lower portion 24 of the housing, the valve is closed. Once the mold structure 16 has moved to the same level as the door in the lower portion 24 of the housing 12, the door is opened and the mold structure is withdrawn from the housing. The cover 78 remains on the mold 16 from the time when the cover is replaced after pouring of molten metal until after the mold structure is removed from the housing 12.

Conclusion

In view of the foregoing description, it is apparent that the present invention provides a new and improved method of casting. The improved method of casting prevents the introduction of contaminants into a mold structure 16 during preheating of the mold structure and/or prevents volatilization of constituent elements from molten metal in the mold structure during solidification of the molten metal. During a casting operation, an upper end portion 74 of a mold structure 16 is blocked by a cover 78 or other device, to prevent movement of fluid through the upper end portion of the mold structure into the article molds 64. The mold structure 16 is preheated while the upper end portion 74 of the mold structure is blocked. Since the upper end portion of the mold structure 16 is blocked during preheating of the mold structure, contaminants in the environment around the mold structure cannot enter the mold structure.

Once the mold structure 16 has been preheated to the desired temperature, the upper end portion 74 of the mold structure is unblocked and a flow of molten metal is conducted into the mold structure. Thereafter, the upper end portion 74 of the mold structure 16 is again blocked and the mold structure is withdrawn from the furnace chamber 18 while the upper end portion of the mold structure is blocked. By blocking the upper end portion 74 of the mold structure 16 during withdrawal of the mold structure from the furnace chamber, volatilization of elements in the molten metal is blocked and the rate of heat loss from the upper end portion of the mold structure is reduced. Although it is preferred to block the upper end portion 74 of the mold structure 16 during preheatin of the mold structure and withdrawal of the mold structure from the furnace chamber 18, the upper end portion of the mold structure may be blocked only during preheating or only during withdrawal of the mold structure.

Having described one specific embodiment of the invention, the following is claimed:

1. A method of casting, said method comprising the steps of providing a mold structure having an open upper end portion connected in fluid communication with an article mold cavity, moving the mold structure into a furnace chamber, blocking the upper end portion of the mold structure to block movement of fluid through the upper end portion of the mold structure into the article mold cavity, preheating the mold structure while the mold structure is at least partially in the furnace chamber and while blocking the upper end portion of the mold structure, unblocking the upper end portion of the mold structure after preheating the mold structure and while the mold structure is at least partially in the furnace chamber, thereafter, conducting a flow of molten metal through the upper end portion of the preheated mold structure into the article mold cavity, thereafter, again blocking the upper end portion of the mold structure by engaging the upper end portion of the mold structure with a cover, and withdrawing the mold structure from the furnace chamber while blocking the upper end portion of the mold structure by maintaining the cover in engagement with the upper end portion of the mold structure.

2. A method as set forth in claim 1 wherein said step of blocking the upper end portion of the mold structure is performed prior to performance of said step of moving the mold structure into the furnace chamber.

3. A method as set forth in claim 2 wherein the upper end portion of the mold structure is continuously blocked during at least a portion of the movement of the mold structure into the furnace chamber and until after the mold structure has been preheated.

4. A method as set forth in claim 1 wherein the upper end portion of the mold structure is continuously blocked after performing said step of again blocking the upper end portion of the mold structure until after the mold structure has been withdrawn from the furnace chamber.

5. A method as set forth in claim 1 wherein said step of blocking the upper end portion of the mold structure includes moving a cover to a blocking position in which the cover blocks the movement of fluid into the article mold cavity through the upper end portion of the mold structure, said step of moving a cover to a blocking position being performed with the mold structure and cover outside of the furnace chamber.

6. A method as set forth in claim 5 wherein said step of again blocking the upper end portion of the mold structure includes moving the cover to the blocking position with the mold structure at least partially inside the furnace chamber.

7. A method as set forth in claim 5 wherein said step of moving the mold structure into a furnace chamber includes moving the cover through the furnace chamber to a position outside of the furnace chamber.

8. A method as set forth in claim 7 wherein said step of unblocking the upper end portion of the mold structure is performed with the cover outside of the furnace chamber and the mold structure at least partially in the furnace chamber.

9. A method as set forth in claim 1 wherein said step of blocking the upper end portion of the mold structure includes moving a cover to a blocking position in which the cover blocks movement of fluid into the article mold cavity through the upper end portion of the mold structure, said step of unblocking the upper end portion of the mold structure including moving the cover to a location outside of the furnace chamber and in which the cover is ineffective to block movement of fluid into the article mold cavity while the mold structure is at least partially in the furnace chamber, said step of again blocking the upper end portion of the mold structure includes moving the cover back to the blocking position.

10. A method as set forth in claim 9 wherein said step of withdrawing the mold structure from the furnace chamber is performed with the cover in the blocking position.

11. A method as set forth in claim 10 wherein said step of moving the mold structure into the furnace chamber is performed with the cover in the blocking position.

12. A method of casting comprising the steps of providing a mold structure having an open upper end portion, moving the mold structure into a furnace chamber having an upper side wall, moving a cover to a closed position in which the cover engages the upper end portion of the mold structure and blocks movement of fluid into the mold structure through the upper end portion of the mold structure, preheating the mold structure while the mold structure is at least partially in the furnace chamber and while the cover is in the closed position, moving the cover to an open position in which the cover is ineffective to block movement of fluid into the mold structure, pouring molten metal through an opening in the upper wall of the furnace chamber and through the upper portion of the mold structure while the cover is in the open position, moving the cover back to the closed position after performing said step of pouring molten metal, and moving the mold structure out of the furnace chamber while maintaining the cover in engagement with the upper end portion of the mold structure.

13. A method as set forth in claim 12 wherein said step of moving the mold structure into the furnace chamber is performed with the cover in the closed position.

14. A method as set forth in claim 12 wherein said step of moving the cover to an open position includes moving the cover to an open position in which the cover is disposed outside of the furnace chamber.

15. A method as set forth in claim 12 further including the step of moving the cover through an opening in the upper wall of the furnace chamber during performance of said step of moving the mold structure out of the furnace chamber.

16. A method of casting, said method comprising the steps of providing a mold structure having an open upper end portion connected in fluid communication with an article mold cavity, blocking the upper end portion of the mold structure to block movement of fluid into the article mold cavity through the upper portion of the mold structure by engaging the upper end portion of the mold structure with a cover, moving the mold structure into a furnace chamber while blocking the upper end portion of the mold structure by maintaining the cover in engagement with the upper end portion of the mold structure; preheating the mold structure while the mold structure is at least partially in the furnace chamber and while blocking the upper end portion of the mold structure by maintaining the cover in engagement with the upper end portion of the mold structure, unblocking the upper end portion of the mold structure after preheating the mold structure and while the mold structure is at least partially in the furnace chamber by disengaging the cover from the upper end portion of the mold structure, and, thereafter, conducting a flow of molten metal through the upper end portion of the preheated mold structure into the article mold cavity.

17. A method as set forth in claim 16 further including the steps of again blocking the upper end portion of the mold structure after performing said step of conducting a flow of molten metal through the open upper end portion of the preheated mold structure.

18. A method as set forth in claim 17 further including the step of withdrawing the mold structure from the furnace chamber while blocking the upper end portion of the mold structure.

19. A method as set forth in claim 16 wherein said step of conducting a flow of molten metal through an open upper end portion of the mold structure into the article mold cavity includes pouring molten metal through an opening in an upper wall of the furnace chamber into the upper end portion of the mold structure.

20. A method as set forth in claim 16 wherein said step of engaging the upper end portion of the mold structure with a cover is performed with the mold structure and cover outside the furnace chamber.

21. A method as set forth in claim 20 wherein said step of unblocking the upper end portion of the mold structure includes moving the cover away from the upper end portion of the mold structure.

22. A method as set forth in claim 21 further including the step of moving the cover back into engagement with the mold structure after performing said step of conducting a flow of molten metal through the open upper end portion of the preheated mold structure into the article mold cavity.

23. A method as set forth in claim 22 further including the step of withdrawing the mold structure from the furnace chamber while maintaining the cover in engagement with the upper end portion of the mold structure.

24. A method of casting, said method comprising the steps providing a mold structure having an open upper end portion connected in fluid communication with an article mold cavity, moving the mold structure into a furnace chamber, moving a cover to a closed position blocking the upper end portion of the mold structure by engaging the upper end portion of the mold structure with the cover, evacuating the article mold cavity with the cover in the closed position, preheating the mold structure while the mold structure is at least partially in the furnace chamber and the cover is in the closed position, conducting a flow of molten metal into the evacuated article mold cavity in the preheated mold structure while the mold structure is at least partially in the furnace chamber, and thereafter, withdrawing the mold structure from the furnace chamber while engaging the upper end portion of the mold structure with the cover.

25. A method as set forth in claim 24 wherein said step of withdrawing the mold structure from the furnace chamber is performed with the cover in the closed position.

26. A method as set forth in claim 24 wherein said step of moving the mold structure into the furnace chamber is performed with the cover in the close position.

27. A method of casting, said method comprising the steps of providing a mold structure having an open upper end portion connected in fluid communication with an article mold cavity, moving the mold structure into a furnace chamber, preheating the mold structure while the mold structure is at least partially in the furnace chamber, conducting a flow of molten metal through the upper end portion of the preheated mold structure into the article mold cavity, thereafter, engaging the upper end portion of the mold structure with a cover to block movement of fluid through the upper end portion of the mold strcture, and withdrawing the mold structure from the furnace chamber while blocking the upper end portion of the mold structure with the cover by engaging the upper end portion of the mold structure with the cover.

28. A method as set forth in claim 27 wherein said step of moving the mold structure into the furnace chamber is performed with the cover blocking the upper end portion of the mold structure.

29. A method as set forth in claim 27 wherein said step of preheating the mold structure is performed with the cover blocking the upper end portion of the mold structure.

30. A method as set forth in claim 29 further including the step of removing the cover from the upper end portion of the mold structure after preheating the mold structure and prior to performance of said step of conducting a flow of molten metal into the article mold cavity.

31. A method as set forth in claim 27 wherein said step of conducting a flow of molten metal through the open upper end portion of the preheated mold structure into the article mold cavity includes conducting a flow of molten metal through an opening in an upper wall of the furnace chamber.

32. A method as set forth in claim 27 wherein said step of withdrawing the mold structure from the furnace chamber includes moving the cover through an opening in an upper wall of the furnace chamber.

33. A method as set forth in claim 32 wherein said step of moving the cover through an opening in an upper wall of the furnace chamber is performed with the cover in engagement with the upper end portion of the mold structure.

34. A method of casting, said method comprising the steps of providing a mold structure having an open upper end portion connected in fluid communication with an article mold cavity, moving the mold structure into a furnace chamber having an upper side wall, said step of moving the mold structure into the furnace chamber including moving the upper end portion of the mold structure at least part way through an opening in the upper side wall of the furnace chamber, engaging the upper end portion of the mold structure with a cover, preheating the mold structure while engaging the upper end portion of the mold structure with a cover and while the upper end portion of the mold structure is at least part way through the opening in the upper side wall of the furnace chamber, disengaging the cover from the upper end portion of the preheated mold structure, thereafter, conducting a flow of molten metal through the upper end portion of the preheated mold structure into the article mold cavity while the upper end portion of the mold structure is at least part way through the opening in the upper side wall of the furnace chamber, thereafter, again engaging the upper end portion of the mold structure with the cover while the upper end portion of the mold structure is at least part way through the opening in upper side wall of the furnace chamber, and withdrawing the mold structure from the furnace chamber with the cover in engagement with the upper end portion of the mold structure.

35. A method as set forth in claim 34 wherein said step of withdrawing the mold structure from the furnace chamber includes moving the cover through the opening in the upper side wall of the furnace chamber.

36. A method as set forth in claim 35 wherein said step of moving the mold structure into the furnace chamber includes moving the cover through the opening in the upper side wall of the furnace chamber.

* * * * *

UNITED STATES PATENT AND TRADEMARK OFFICE

CERTIFICATE OF CORRECTION

PATENT NO. : 5,046,547

DATED : September 10, 1991

INVENTOR(S) : James Abua Oti

It is certified that error appears in the above-identified patent and that said Letters Patent is hereby corrected as shown below:

Column 11, Line 68, Claim 24, after "steps" insert --of--.

Column 12, Line 22, Claim 24, change "close" to --closed--.

Signed and Sealed this

Fifth Day of January, 1993

*Attest:*

DOUGLAS B. COMER

*Attesting Officer*

*Acting Commissioner of Patents and Trademarks*